US011006769B2

(12) United States Patent
Yoo

(10) Patent No.: US 11,006,769 B2
(45) Date of Patent: May 18, 2021

(54) EASEL BACK FOR PICTURE FRAME

(71) Applicant: Joo Hyeong Yoo, Chester, NY (US)

(72) Inventor: Joo Hyeong Yoo, Chester, NY (US)

( * ) Notice: Subject to any disclaimer, the term of this patent is extended or adjusted under 35 U.S.C. 154(b) by 0 days.

(21) Appl. No.: 16/715,700

(22) Filed: Dec. 16, 2019

(65) Prior Publication Data

US 2020/0187680 A1 Jun. 18, 2020

Related U.S. Application Data

(60) Provisional application No. 62/917,574, filed on Dec. 17, 2018.

(51) Int. Cl.
*A47G 1/16* (2006.01)

(52) U.S. Cl.
CPC ..... *A47G 1/16* (2013.01)

(58) Field of Classification Search
CPC ..... A47B 23/043; A47B 23/044; A47B 97/08; A47B 2220/0019; A47F 5/112; A47F 5/11; A47G 1/16; A47G 1/1613
USPC .... 248/441.1, 448, 447, 454–465, 472, 475, 248/690, 205.2, 205.3, 919, 917; 40/124.07–124.19, 761, 762, 748, 754
See application file for complete search history.

(56) References Cited

U.S. PATENT DOCUMENTS

| | | | | |
|---|---|---|---|---|
| 588,636 | A * | 8/1897 | Engstrom | A47B 97/08 248/465 |
| 2,845,733 | A | 8/1958 | Fox | |
| 2,889,646 | A | 6/1959 | Matthias et al. | |
| 4,450,638 | A | 5/1984 | Bader | |
| 4,722,504 | A * | 2/1988 | Degenholtz | A47B 23/044 248/174 |
| 5,058,850 | A | 10/1991 | Glick | |
| 5,149,047 | A * | 9/1992 | Tucker | A47B 23/044 248/174 |
| 5,927,673 | A * | 7/1999 | Kurokawa | F16M 11/10 24/462 |
| 6,536,803 | B2 * | 3/2003 | Masson | B42F 13/0006 248/444.1 |
| D513,962 | S * | 1/2006 | Beckwith | D8/322 |
| 7,208,666 | B2 * | 4/2007 | Burch | G10G 5/00 248/243 |
| D851,405 | S * | 6/2019 | Smith | D3/318 |
| 2001/0045500 | A1 * | 11/2001 | Krug | F16M 13/02 248/205.3 |
| 2003/0057343 | A1 * | 3/2003 | Jacobs | A47B 23/04 248/441.1 |

* cited by examiner

*Primary Examiner* — Cassandra Davis
(74) *Attorney, Agent, or Firm* — Saile Ackerman LLC; Stephen B. Ackerman

(57) ABSTRACT

It is an object of one or more embodiments of the present disclosure to provide a method and device for an easel back. The easel back is constructed of a flat foldable member, comprised of three cut outs for folding at the three cut outs, a first hook/loop, on an upper section of a front side of the easel back, configured to attach to a back of a display frame, and a second hook/loop, on the bottom section of a back side of the easel back, configured to attach to a lower part of the display frame.

20 Claims, 4 Drawing Sheets

EASEL BACK FOR PICTURE FRAME

This application claims the benefit of U.S. Provisional patent application Ser. No. 62/917,574, filed on Dec. 17, 2018, which is herein incorporated by reference in its entirety.

BACKGROUND

Field

The present disclosure relates generally to photograph display devices. More particularly, the present invention relates to a photograph display device that provides a collapsible and viewing angle adjustable display device, constructed of a sheet material such as corrugated plastic or cardboard, which in a collapsed state provides for easy transportation, and in an erect state provides an easel back for displaying a photograph or the like.

Background

The conventional picture frame, with a limited angle cardboard easel foot folding out from the rear panel to support the picture frame on a table or any flat surface, is well known in the art. This standard in the industry is adequate for supporting a picture frame or other display at a fixed viewing angle on a horizontal surface. The structure of the conventional easel back has a number of drawbacks.

Shortcomings associated with the conventional easel back include but are not limited to the following. For sellers of conventional easel backs and picture frames, there is a need to stock a range of easel backs of varying dimensions, as each standard size of picture frame typically requires an easel that precisely fits its dimensions. There is only a single, fixed angle of picture frame inclination obtainable with a particular easel back, and this angle cannot be varied, since the typical easel back is a simple hinged structure which is either open or closed. The assembly is relatively unstable when bumped, so that the picture frame may topple over. The construction is not easily removable to convert to a wall hanging. And, many picture frames are unavailable for use with a stand-up application.

SUMMARY

The present invention seeks to provide a solution to these problems by providing an easel back that is adjustable to change the angle for viewing, easy to assemble without tools, folds flat to transport easily, is easy to package, is usable for various picture frame sizes, provides stability for a picture frame, and is easily removed to hang a picture frame on the wall.

Accordingly, it is an object of one or more embodiments of the present disclosure to provide an easel back with an adjustable angle for the viewer while providing solid support for the display.

It is a further object of one or more embodiments of the present disclosure to provide an easel back which is flat in its shipping configuration and can be easily packaged.

Still further, it is an object of one or more embodiments of the disclosure to provide a picture frame useable with a range of picture frames of different sizes, shapes and profiles.

The above and other objects of the present disclosure may be accomplished in the following manner. An easel back is disclosed, comprising a flat foldable member, comprised of three cut outs, for folding at the three cut outs, a first hook/loop, on an upper section of a front side of the easel back, configured to attach to a back of a display frame, a second hook/loop, on the bottom section of a back side of the easel back, configured to attach to a lower part of the display frame.

The above and other objects of the present disclosure may be further accomplished with a method for using an easel back. The steps include providing an easel back, comprising a flat foldable member comprising three cut outs, a first hook/loop, on an upper section of a front side of the easel back, and a second hook/loop, on a bottom section of a back side of the easel back. The steps also include folding the easel back at the three cut outs. The steps also include attaching the first hook/loop to a first opposing hook/loop on a back of display frame. The steps also include attaching the second hook/loop to a second opposing hook/loop on a lower part of the display frame.

The object of this disclosure includes its variants, and its alternative embodiments, independently of its applications or processes it may be applied to.

BRIEF DESCRIPTION OF THE DRAWINGS

The present disclosure will be more clearly understood from the following description taken in conjunction with the accompanying drawings in which like reference numerals designate similar or corresponding elements, regions and portions and in which.

DETAILED DESCRIPTION

The present disclosure proposes an easel back, comprising a flat rectangular shaped foldable member, formed of a sturdy resilient material, such as corrugated plastic or cardboard.

An important aspect of the disclosed easel back is the use of hook-and-loop fasteners commonly referred to as velcro. Such fasteners consist of two parts, i.e., lineal fabric strips which are attached to opposing surfaces to be fastened. The first component features very small hooks, the second features smaller loops. When the two are pressed together the hooks catch in the loops and the two pieces fasten or bind temporarily and can be readily separated by pulling them apart. In the disclosure, where a hook is described attached to a first surface and a loop to a second surface to be joined, the hook portion and loop portion could be interchanged, with the loop on the first surface and the hook on the second. Similarly, the wording "hook/loop" is used to disclose the use of either a hook or loop part, with the corresponding part to which it is to be attached comprising the opposite type of fastener.

Figure 1:
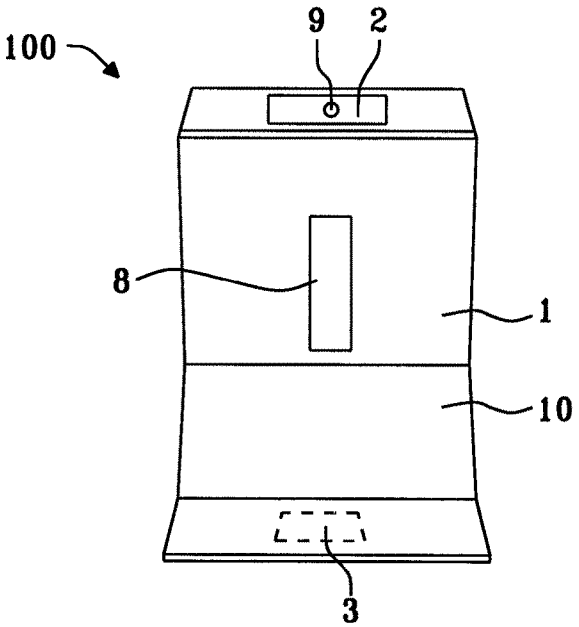
FIG. 1 is a view of a front side of the easel back of the disclosure, showing the surface that faces a picture frame.
Figure 10:
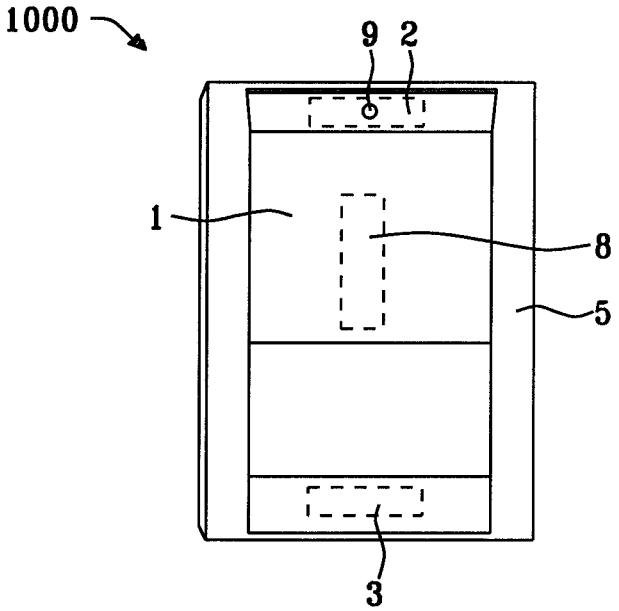
FIG. 10 is a view of the easel back collapsed onto the picture frame for transportation or storage, or for wall mounting.

FIG. 1 consists of 100, a view of a front side 10 of the easel back 1 as it would face a picture frame to which it can be attached. FIG. 1 includes first hook 2, on the upper top of the front side of the easel back 1. There is preferably a hole 9 punched through the center of hook 2 and the upper top of the easel back. Hook 8 is provided in a central section of easel back 1, for attachment to a middle section of the back side of a picture frame, when the easel back is collapsed, as shown in FIG. 10. Second hook 3 is provided on a lower section of easel back 1 for attaching to a bottom portion of the picture frame, also as depicted in later drawings.

Figure 2:
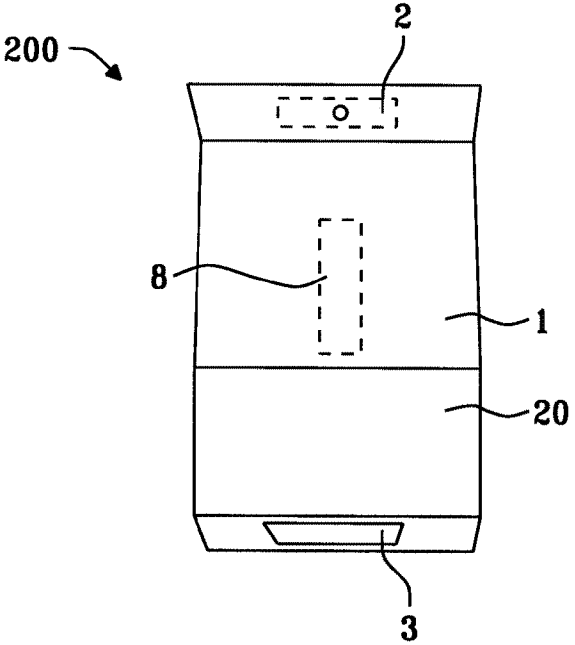
FIG. 2 is a view of a back side of the easel back, showing the surface that faces away from the picture frame.

FIG. 2 shows view 200, depicting a back side 20 of the easel back, where the back side 20 is the surface that would face away from the picture frame when attached. FIG. 2 includes hook 3, on the bottom of the back side of the easel back. Hook 3 is approximately the same size as hook 2, in a preferred implementation, but doesn't have to be.

Figure 3:
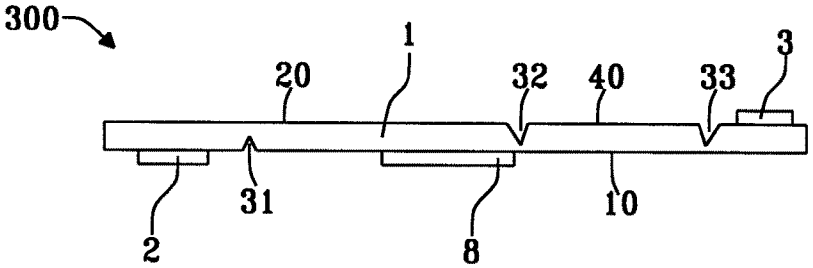
FIG. 3 is a side view of the easel back showing the locations of where and how the easel back folds.

FIG. 3 depicts side view 300 of the easel back 1, showing hook locations as well as cut outs, to allow for the easel back 1 to fold easily. FIG. 3 includes hooks 2, 3, and 8. Hook 2 is a hook material, on the front side 10 of the easel back, which attaches to the upper part of the picture frame at loop 6. Hook 3 is a hook material, on the back side 20 of the easel back, which attaches to the lower part of the picture frame, at loop 7 shown in FIG. 4.

The easel back 1 can be made by cutting a piece of, preferably, corrugated plastic to the desired height and width dimensions. Cut outs 31, 32, and 33 are each formed by the removal of material along two opposing cuts, at approximately 45-degree angles to the surface, as shown in FIG. 3. The first of three cut outs 31 is located on the same side of the easel back as first hook 2, and adjacent to hook 2. The second of three cut outs 33 is located on the same side of the easel back as second hook 3, and adjacent to hook 3. The third of three cut outs 32 is located on the same side of the easel back as second hook 3, and adjacent to hook 8, on the reverse side.

The portion of the easel back 1 resting on a horizontal surface, 40, would typically be flush with the horizontal surface, and with the bottom of the picture frame, when the easel back is folded and attached by its hooks and loops. While corrugated plastic is the preferred material for easel back 1, it could also be formed of other rigid lightweight materials such as corrugated cardboard, wood, metal, or the like. Furthermore, the easel back 1 can have dimensions, preferably, of a width of about 4 inches and a length of about 6 and ¾ inches.

Figure 4:
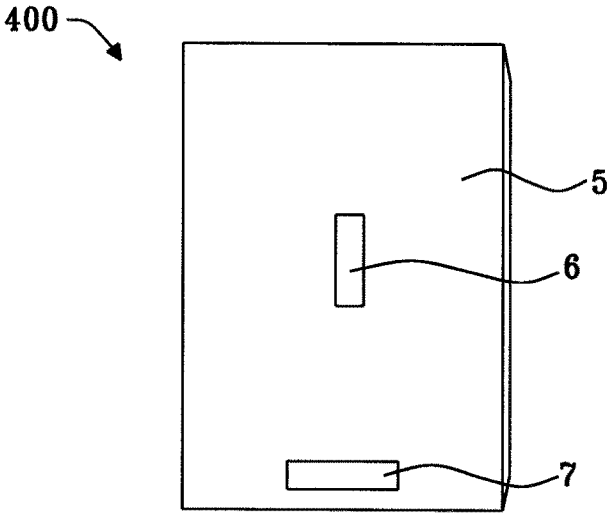
FIG. 4 is a view of the back side of the picture frame showing the locations of the loops attached to the picture frame itself.

FIG. 4 consists of a back side view 400 of the back of picture frame 5, showing the locations of loops to which the disclosed easel back attaches. Loop 6 attaches to hook 2 when the easel back is used for display on a horizontal surface, and to hook 8, at a middle section of the front side of the easel back, when the easel back is collapsed onto the picture frame for transportation or storage, or for mounting to a wall.

Figure 5:
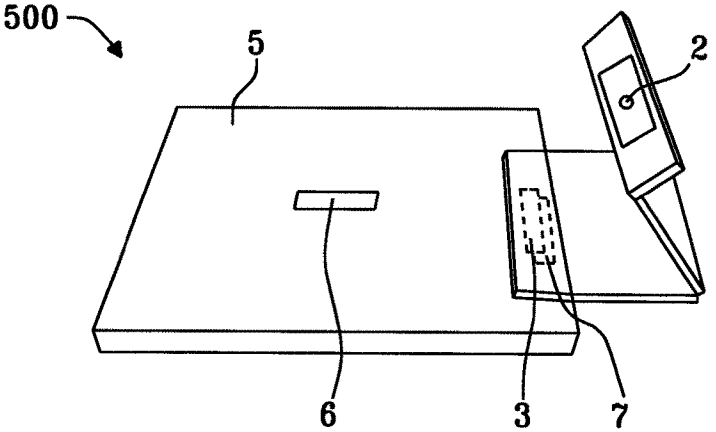
FIG. 5 is a view of the back of the picture frame, and the bottom hook of the easel back attached to the loop on the bottom of the picture frame.

FIG. 5 includes view 500, showing the back of the picture frame and partly connected easel back. The bottom hook 3 of the easel back is attached to loop 7, on the bottom of picture frame 5.

Figure 6:
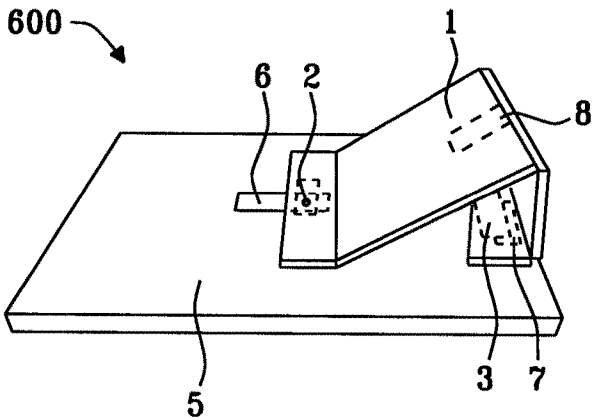
FIG. 6 is a view of the back of the picture frame, with the easel back folded and attached by its hooks and loops.

FIG. 6 depicts view 600 of the back of the picture frame, with the easel back folded and attached by its hooks and loops. FIG. 6 shows the attachment of the folded easel back hooks 2 and 3 to loops 6 and 7, respectively. Loop 6 is oriented with its long side in a vertical orientation, to allow for the attachment of hook 2 at different heights along loop 6, which allows for easily changing the angle of the picture frame when resting on a horizontal surface.

Figure 7:
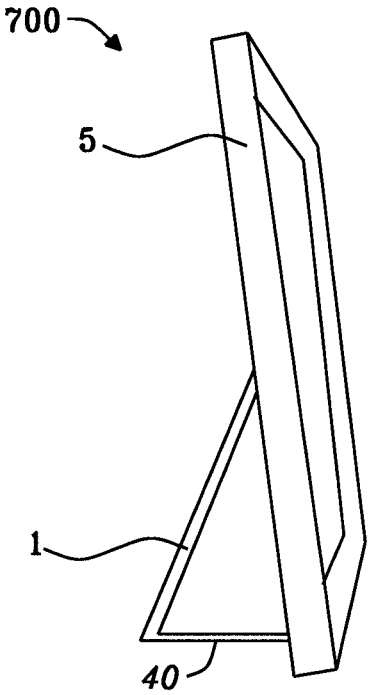
FIG. 7 is a side view of the easel back, including a partial view of the front of the picture frame with the easel back attached to the back of the picture frame.

FIG. 7 shows perspective side view 700, a side view of the easel back, including a partial view of the front of the picture frame with easel back 1 attached to the back of picture frame 5, with the frame and easel in an upright position for display on a horizontal surface (not shown). The portion of the easel back 1 resting on the horizontal surface, 40, would typically be flush with the horizontal surface, and with the bottom of the picture frame.

Figure 8:
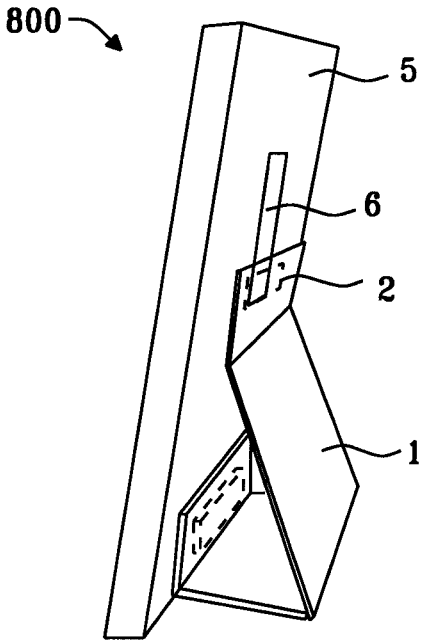
FIG. 8 is a side view of the easel back, including a partial view of the back of the picture frame with the easel back attached to the back of the picture frame.

FIG. 8 depicts perspective back view 800 showing the easel back, and a partial view of the back of the picture frame with the easel back attached to the back of the picture frame. FIG. 8 shows loop 6 attached to picture frame 5, allowing the height of hook 2 to be adjusted, to allow for changing the viewing angle of the picture frame.

Figure 9:
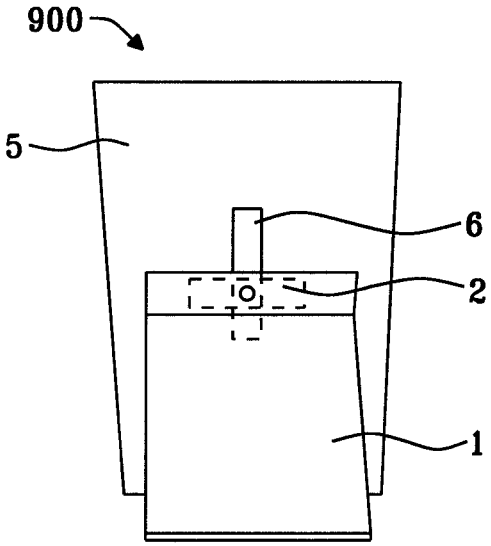
FIG. 9 is a back view of the easel back attached to the back of the picture frame.

FIG. 9 shows back view 900, with the easel back attached to the back of the picture frame. FIG. 9 shows the location of loop 6 and hook 2, for adjusting the angle of the easel back by shifting hook 2 on loop 6.

FIG. 10 provides back view 1000, with the easel back collapsed flat against the picture frame for transportation or storage, or for wall hanging using hole 9. Loop 6 attaches to hook 8 when easel 1 is collapsed onto picture frame 5.

Figure 11:
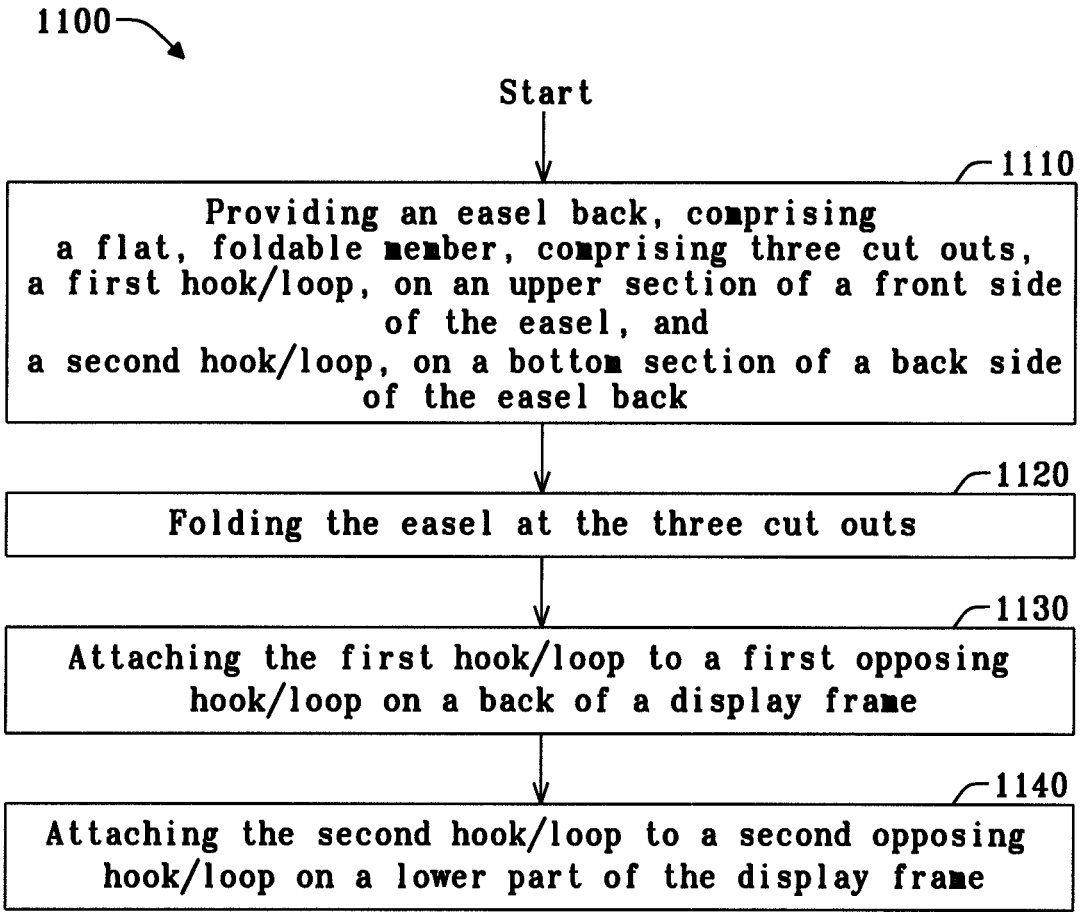
FIG. 11 is a flowchart of a method for using an easel back.

FIG. 11 is flow chart 1100, of a method for using an easel back. The steps include 1110, providing an easel back, comprising a flat foldable member comprising three cut outs, a first hook/loop, on an upper section of a front side of the easel back, and a second hook/loop, on a bottom section of a back side of the easel back. The steps also include 1120, folding the easel back at the three cut outs. The steps also include 1130, attaching the first hook/loop to a first opposing hook/loop on a back of display frame. The steps also include 1140, attaching the second hook/loop to a second opposing hook/loop on a lower part of the display frame.

The main advantages of one or more embodiments of the present disclosure include providing an easel back that is adjustable to change the angle for viewing, easy to assemble without tools, folds flat to transport easily, easy to package, usable for various picture frame sizes, provides stability for a picture frame and is easily removed to hang a picture frame on the wall.

While particular embodiments of the present disclosure have been illustrated and described, it will be understood by those skilled in the art that various changes in form and details may be made without departing from the spirit and scope of the invention.

What is claimed is:

1. An easel back, comprising:

a flat foldable member, comprising three folds, configured to fold at each of the three folds;

a first fastener, on an upper section of a front side of the easel back, configured to attach to a back of a display frame;

a second fastener, on a bottom section of a back side of the easel back, configured to attach to a lower part of the display frame; and wherein the first fastener is configured to attach at different heights to the back of the display frame, wherein attaching at said different heights allows a multiplicity of angles of the display frame relative to, and when resting on, a horizontal surface, wherein said multiplicity comprises 3 or more angles.

2. The easel back of claim 1, further comprising a hole punched through the first fastener and through an adjoining section of said easel back.

3. The easel back of claim 1, wherein the second fastener is approximately a same size as the first fastener.

4. The easel back of claim 1, wherein the easel back has a width of about 4 inches and a length of about 6 and % inches.

5. The easel back of claim 1, wherein the flat foldable member comprises corrugated plastic.

6. The easel back of claim 1, wherein the flat foldable member comprises corrugated cardboard.

7. The easel back of claim 1, wherein the easel back is configured to be folded flat against said display frame, for transportation or storage, or for wall mounting.

8. The easel back of claim 7, further comprising a third fastener on a middle section of the front side of the easel back, configured to attach to the display frame when the easel back is folded flat.

9. The easel back of claim 8, wherein the third fastener comprises a hook/loop.

10. The easel back of claim 1, wherein a first of the three folds is located on the same side of the easel back as the first fastener, and under the first fastener.

11. The easel back of claim 1, wherein a second and third of the three folds are located on the same side of the easel back as the second fastener, and above the second fastener.

12. The easel back of claim 1, wherein each of the three folds comprise a cut out.

13. The easel back of claim 1, wherein the first and second fasteners comprise a hook/loop.

14. A method for making an easel back, comprising the steps of:

cutting a foldable member, having length and width dimensions;

making three folds in the foldable member, each parallel to said width dimension;

applying a first fastener, on an upper section of a front side of the easel back; applying a second fastener, on a bottom section of a back side of the easel back;

adjusting an angle of said easel back by moving a vertical positioning of said first fastener against an opposing fastener; and allowing a multiplicity of said angles, wherein said multiplicity comprises 3 or more said angles.

15. The method of claim 14, further comprising punching a hole through a center of the first fastener and through an adjoining portion of said easel back.

16. The method of claim 14, further comprising making the second fastener approximately a same size as the first fastener.

17. The method of claim 14, further comprising cutting the foldable member to a width of about 4 inches and a length of about 6 and % inches.

18. The method of claim 14, further comprising applying a third fastener on a middle section of a front side of the easel back.

19. A method for using an easel back, comprising the steps of:

providing the easel back, comprising:

a flat foldable member, comprising three folds;

a first fastener, on an upper section of a front side of the easel back; and a second fastener, on a bottom section of a back side of the easel back;

folding the easel back at the three folds;

attaching the first fastener to a first opposing fastener on a back of a display frame;

attaching the second fastener to a second opposing fastener on a lower part of the display frame;

adjusting an angle of said display frame by moving a vertical positioning of said first fastener against said first opposing fastener; and allowing a multiplicity of said angles, wherein said multiplicity comprises 3 or more said angles.

20. The method of claim 19, further comprising positioning said easel back to said display frame and folding said easel back so that a middle section of said easel back is placed on a horizontal surface, to support said display frame for display.

* * * * *